US010249280B1

(12) United States Patent
Blake

(10) Patent No.: US 10,249,280 B1
(45) Date of Patent: Apr. 2, 2019

(54) HIGH PRESSURE GAS SILENCER

(71) Applicant: Keegan W. Blake, Loveland, CO (US)

(72) Inventor: Keegan W. Blake, Loveland, CO (US)

( * ) Notice: Subject to any disclaimer, the term of this patent is extended or adjusted under 35 U.S.C. 154(b) by 0 days.

(21) Appl. No.: 16/017,660

(22) Filed: Jun. 25, 2018

Related U.S. Application Data

(60) Provisional application No. 62/543,237, filed on Aug. 9, 2017.

(51) Int. Cl.
*G10K 11/16* (2006.01)

(52) U.S. Cl.
CPC ..... *G10K 11/161* (2013.01)

(58) Field of Classification Search
CPC . G10K 11/161; F16L 55/02718; F16L 55/027
USPC ..... 181/237, 223, 233
See application file for complete search history.

(56) References Cited

U.S. PATENT DOCUMENTS 4,375,841 A * 3/1983 Vielbig ..... F16L 55/02709 181/230
4,751,980 A * 6/1988 DeVane ..... F01N 1/04 181/224
5,097,924 A * 3/1992 Reeves ..... F01N 1/082 181/230
8,523,141 B2 * 9/2013 Elliott ..... F16K 47/08 251/127
9,534,725 B1 * 1/2017 Tecson ..... F16L 55/02718

OTHER PUBLICATIONS http://www.globalindustrial.com/printProduct?itemKey=30837098.

* cited by examiner

*Primary Examiner* — Forrest M Phillips
(74) *Attorney, Agent, or Firm* — Patent Law Offices of Rick Martin, P.C.

(57) ABSTRACT

A silencer reduces the noise from a venting high or low pressure gas outlet port. The exhaust holes are on the side of the cylindrical body. A lower nut is loosened to point the exhaust holes downwind for safety concerns. A disposable soft module embodiment and an all metal non-disposable embodiment is disclosed.

21 Claims, 7 Drawing Sheets

Fig. 7
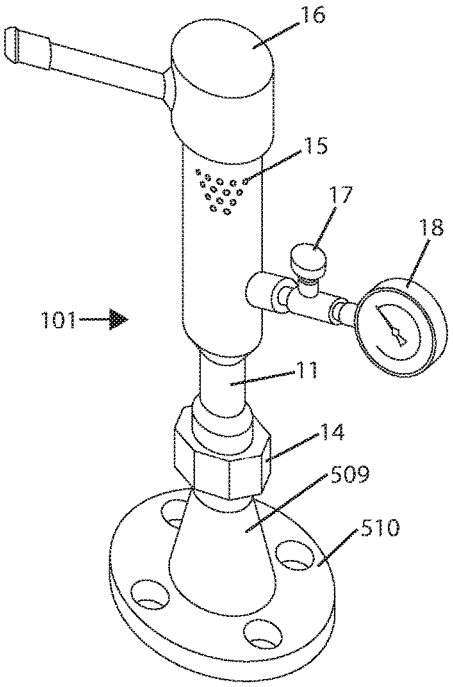
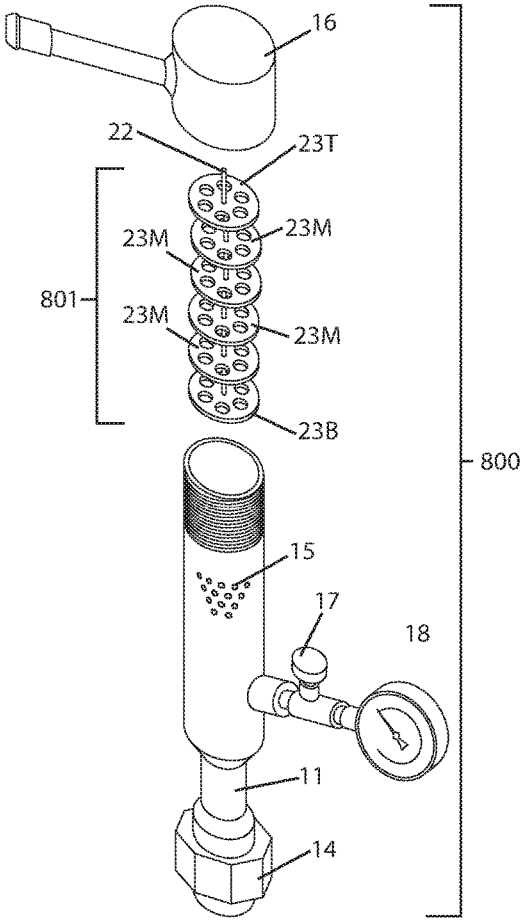
Fig. 8

HIGH PRESSURE GAS SILENCER

CROSS REFERENCE PATENTS

The present non-provisional application claims priority to provisional application No. 62/543,237 filed Aug. 9, 2017 which is incorporated herein by reference in its entirety.

FIELD OF INVENTION

The present invention relates to reducing the noise from vented high pressure gas releases.

BACKGROUND OF THE INVENTION

Venting high pressure gas or steam to atmosphere during a plant or Gas Facility startup or shutdown is a common practice. These controlled releases cause dangerous noise and severe pressure drops on the vent valves. Additionally "Pigging" is a common maintenance function used in high pressure gas lines. Pigging in the context of pipelines refers to the practice of using devices known as "pigs" to perform various maintenance operations. This is done usually without stopping the flow of the product in the pipeline. These operations include but are not limited to cleaning and inspecting the pipeline. This is accomplished by inserting the pig into a "pig launcher" (or "launching station")—an oversized section in the pipeline, reducing to the normal diameter. The launching station is then closed and the pressure-driven flow of the product in the pipeline is used to push the pig along down the pipe until it reaches the receiving trap—the "pig catcher" (or "receiving station"). Each time a "pig" is launched or retrieved, the high or low pressure gas line trap must be vented to atmosphere. Again this causes dangerous noise and stress on the release valve.

CU Services LLC, Elk Grove, Ill. makes a silencer labeled a D800. It has a flange attachment to a release pipe as shown in FIG. 1, labeled as CU 1. Release holes H vent the gas up as shown by arrow CU out. Inside the body of the CU 1 silencer are one or more circular plugs with a plurality of small vent holes. The CU 1 silencer does reduce the noise and stress on the release valve V shown in FIG. 1.

What is needed in the art is a silencer that can direct the vented gas downwind in any direction. What is also needed is a silencer that has improved noise suppression using a replenishable soft barrier wall. The new silencer also offers more portability due to its threaded connection vs. a flanged connection. The present invention meets these needs.

SUMMARY OF THE INVENTION

The main aspect of the present invention is to provide a silencer (also called a noise suppressor) for high and low pressure gas releases that uses a replenishable soft barrier to suppress noise and allows for a replacement barrier when chemicals or erosional velocity destroy the soft barrier.

Another aspect of the present invention is to provide an adjustable gas outlet port to allow the operator to vent the gas downwind.

Other aspects of this invention will appear from the following description and appended claims, reference being made to the accompanying drawings forming a part of this specification wherein like reference characters designate corresponding parts in the several views.

BRIEF DESCRIPTION OF THE DRAWINGS

FIG. 7 is a top perspective view of a flange mount embodiment of the silencer.

FIG. 8 is an exploded view of an alternate embodiment.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
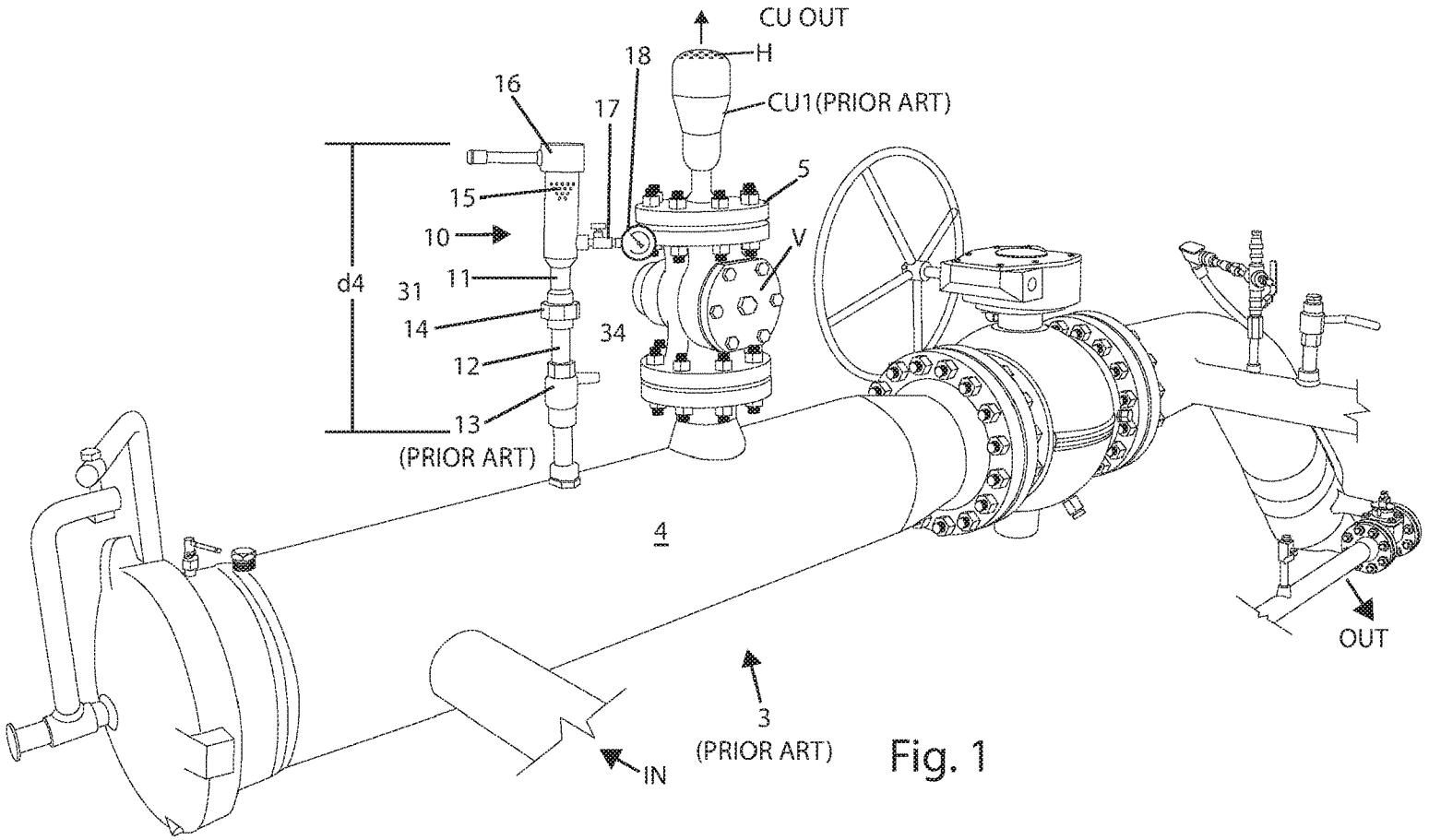
FIG. 1 is a side perspective view of a "PIG" loading station with a prior art vent and silencer and a vent with the present invention installed.

Referring first to FIG. 1 a "pig" launcher/receiver 3 has a main pipe 4 that needs de-pressurizing. Arrows IN and OUT show gas flow. A prior art silencer CU 1 fits onto a four inch vent valve V via a flange 5. High pressure (400 psi plus or minus) and gaseous exhaust is vented straight up as shown by arrow CU OUT.

The present invention silencer 10 has a narrowed connector end 11 that could be sized for any one of several pipe diameters such as ½, ¾, 1 or 2 inch. Alternately a single one inch nut 14 could connect to a swage piece 12 to connect the silencer 10 to a valve 13 of any diameter. Height d4 can vary from about 6 inches to about 18 inches. Design choice to raise above a worker's head could lengthen the height d4 to over 18 inches.

The operator loosens nut 14 and determines the downwind direction. Then he twists the silencer 10 so the vent holes 15 face downwind. Then he tightens the nut 14. Then he opens the valve 13 and discharges the gaseous exhaust downwind. This is safer for the operator than the prior art CU 1 silencer, because the CU 1 exhaust could blow volatile gas or liquid into the operator's face by the ambient wind.

A tap valve 17 allows an exit pressure to be measured by gauge 18. The cap 16 is removable. Arrows IN and OUT show the gas flow.

Figure 2:
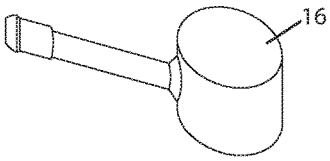
FIG. 2 is an exploded view of silencer 10 depicted in FIG. 1.
Figure 2:
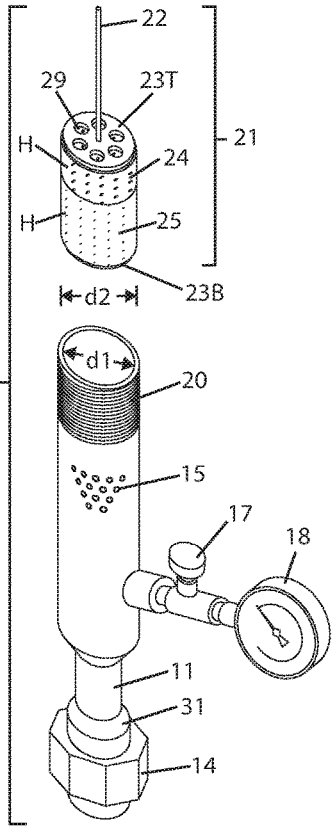

Referring next to FIG. 2 the silencer 10 may have an inside diameter d1=1.90". The disposable soft module 21 has an outside diameter d2 slightly larger than 2.00". A central rod 22 is held in place up against cap 16. The disposable soft module 21 consists of a top flange 23T and a bottom flange 23B. These are preferably stainless steel discs welded to rod 22. A soft sound barrier 25 can be "8800" polyethylene foam (or in the range of 8200-9000) or an equivalent such as steel wool. The harder upper barrier 24 (reticulated particle foam or mesh disc or both) resists chafing. It can be made of a reticulated particle foam. Both soft barriers have holes as shown. Each flange 23T, 23B may have four to eight holes 29 at a diameter of about ⅛ to about ½ inch. Each soft barrier 24,25 can also be welded to rod 22. Each soft and hard barrier has vent holes 11 as shown.

To replace a soft module 21, the gas pressure is shut off. The cap 16 is removed. The old soft module 21 is replaced with a new soft module 21 consisting of items 22,23T, 24, 25, and 23B. The cap 16 is replaced. The gas pressure is turned on.

Figure 3A:
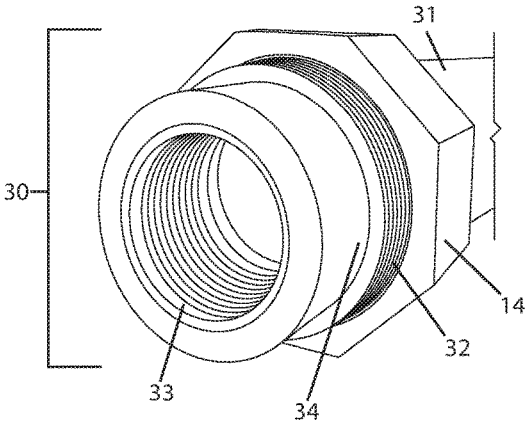
FIG. 3A is a bottom perspective view of the adjustment union of the silencer.

Referring next to FIG. 3A the bottom connector assembly 30 has the nut 14 free spinning on lower shaft 31. It is tightened or loosened on threads 32 to either allow the silencer to turn or to lock it in place. The threads 33 of collar 34 are permanently tightened onto the gas line swage piece or pipe nipple 12. A ridge (not shown) at the base of the silencer holds the nut 14 in a spinable fashion. Thus, tightening the nut 14 on threads 32 draws the ridge tight against the nut 14, locking the silencer at a chosen angle.

Figure 3B:
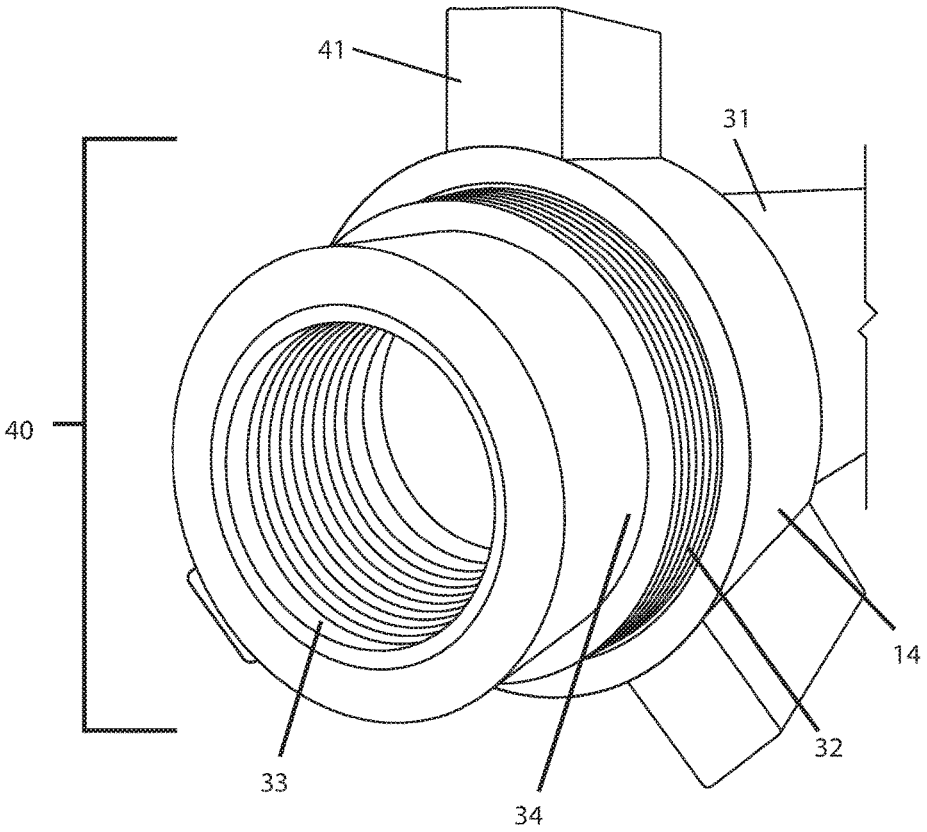
FIG. 3B is a bottom perspective view of an alternate embodiment of an adjustment union.

Referring next to FIG. 3B an alternative union 40 adds three bosses 41 to the outside of nut 14 to allow hammer strikes.

Figure 4:
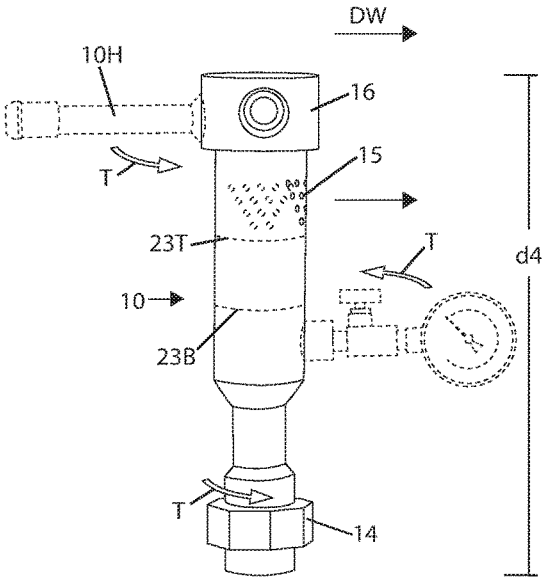
FIG. 4 is a front elevation view of the silencer during an angle adjustment.

Referring next to FIG. 4 the handle 10H can be used to turn (arrows T) the silencer 10 to a desired angle so that the holes 15 face downwind DW. Nominal dimensions of the fourteen holes shown in holes 15 are center to center spacing of about ⅜ inch and hole diameter of about 3/16 inch.

Figure 5:
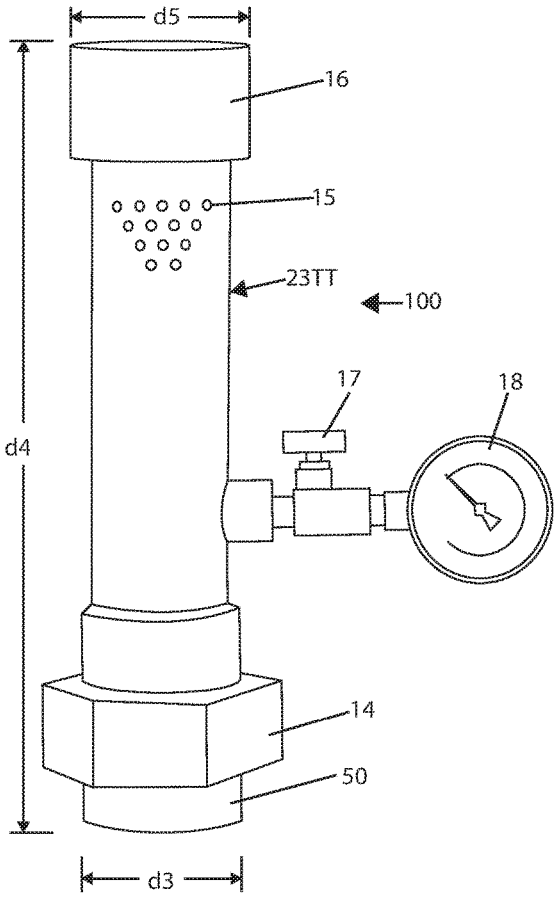
FIG. 5 is a front elevation view of the silencer.

Referring next to FIG. 5 the silencer 100 has a two inch connector base 50. Otherwise it is identical to silencer 10. Nominal dimensions are d4=13 to 18 inches, d3=2 inches, d5=3 inches.

Figure 6:
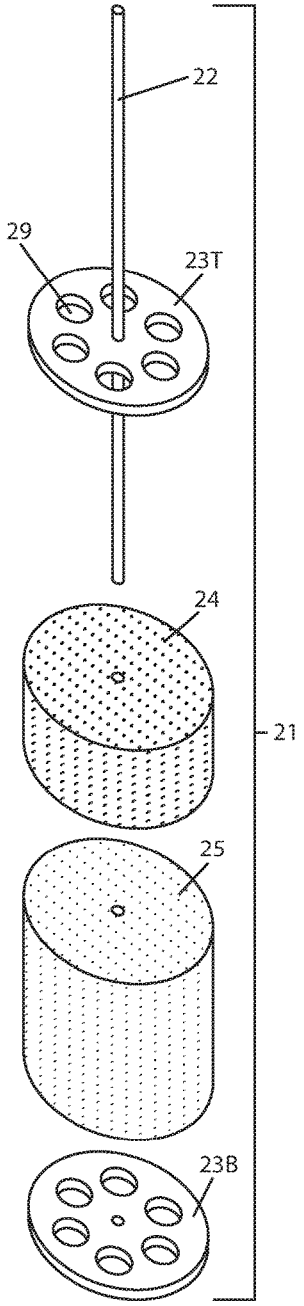
FIG. 6 is an exploded view of the suppressor assembly.
Figure 9:
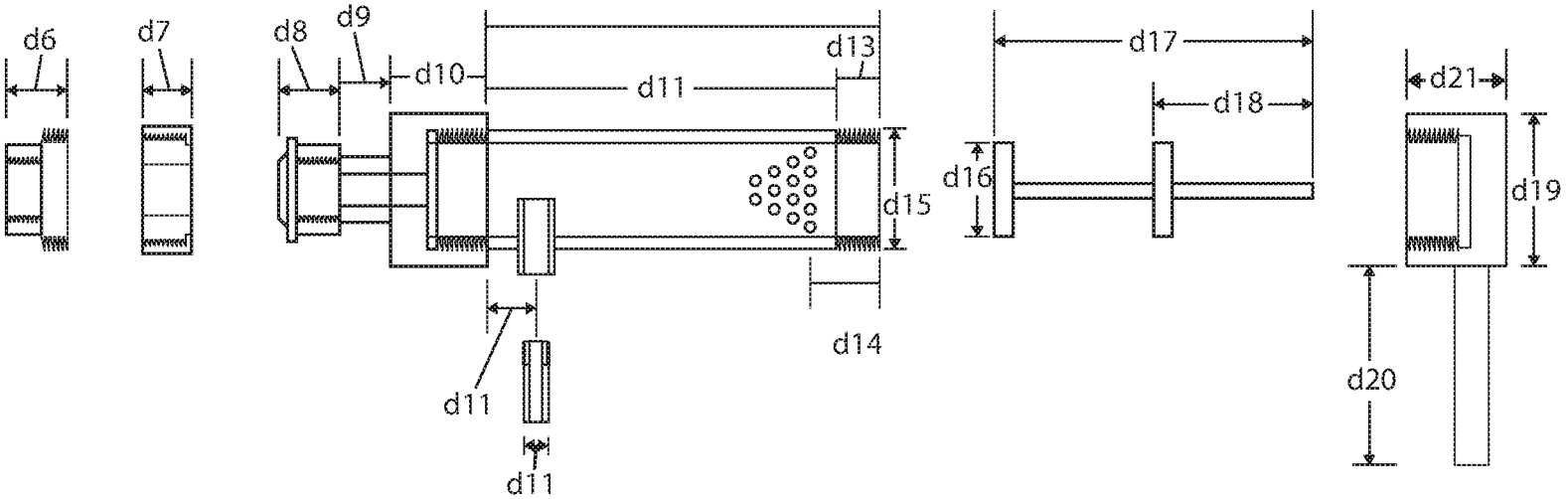
FIG. 9 is a longitudinal sectional view of the FIG. 8 embodiment.
Figure 10:
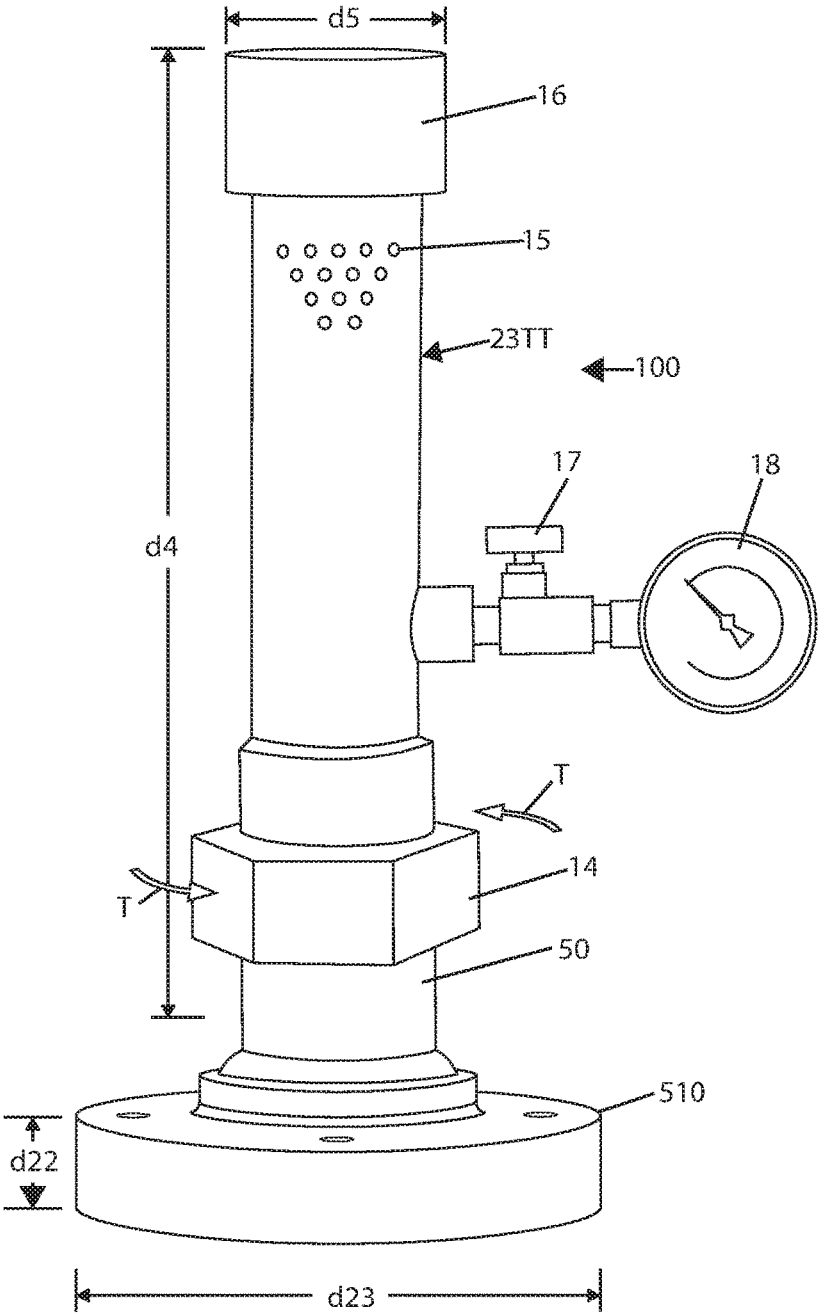
FIG. 10 is a front elevation view of a flange mount embodiment.

Referring next to FIG. 6 the soft module 21 is shown in detail. The top flange 23T must locate under the holes 15 at point 23TT as shown in FIG. 5.

Referring next to FIG. 7 the silencer 101 functions the same as silencers 10,100. The nut 14 tightens onto a connector 509 that has a flange connection 510 to the gas piping.

Referring next to FIG. 8 a non-disposable model of a silencer 800 is shown. The cap 16 may have threads as shown, but it could be permanently attached. An all metal sound module 801 has a plurality of (stainless steel) flanges 23T, 23M, 23B. This unit is not as quiet as the soft module embodiments, but it could be used in extremely caustic gas systems, or it could be chosen as a lower maintenance choice.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A high and low pressure natural gas silencer comprising:

a threaded union to connect to a natural gas pipeline port;

said natural gas pipeline port further comprising a vent valve functioning to allow a venting of a pressurized natural gas to atmosphere;

a cylindrical body connected to the threaded union by a nut assembly;

said nut assembly having a loose mode to allow the cylindrical body to be rotated 360° on the threaded union while remaining attached to the nut assembly, and having a locked mode to affix the cylindrical body at a desired angle;

a plurality of vent holes on only one side of the cylindrical body;

a replacement noise suppression module inside the cylindrical body; and said cylindrical body having a solid top.

2. The silencer of claim 1, wherein the solid top further comprises threads to removably connect to the cylindrical body.

3. The silencer of claim 1, wherein the replacement module further comprises a central rod having an upper and a lower flange supporting a soft replacement module, each flange having vent holes.

4. The silencer of claim 3, wherein the soft replacement module further comprises a soft foam and/or wire member and a hard reticulated particle foam and/or a mesh disc member, each member having vent holes.

5. The silencer of claim 1, wherein the replacement module further comprises a mesh member.

6. The silencer of claim 1, wherein the replacement module further comprises a foam member.

7. The silencer of claim 1, wherein the replacement module further comprises a material having vent holes.

8. The silencer of claim 1, wherein the replacement module is mounted under the plurality of vent holes.

9. The silencer of claim 8, wherein the silencer further comprises a tap valve located under the replacement module, said tap valve having a connection to a pressure gauge, said tap valve having a segment extending into the cylindrical body to support the replacement module.

10. The silencer of claim 1, wherein the plurality of vent holes further comprises at least ten holes each having a diameter of about 3/16 inch.

11. The silencer of claim 1, wherein the threaded union to connect to a gas pipeline port further comprises a flanged connector, and the nut assembly further comprises a connection to a neck on the flanged connector.

12. The silencer of claim 3, wherein each flange further comprises at least four holes, each hole having a diameter of about ⅛ to about ½ inch.

13. The silencer of claim 1, wherein the replacement module further comprises a central rod supporting a plurality of discs having holes.

14. A natural gas pipeline venting port noise suppressor comprising:

a cylindrical housing having an outside diameter of about two inches and a length of at least about six inches;

said cylindrical housing having a bottom with a threaded union assembly to connect to a pipeline venting port;

said pipeline venting port having a vent valve;

said cylindrical housing having a solid top;

said cylindrical housing having an exhaust port on one side only, said one side comprising an angular dimension of less than about 180°; and wherein the threaded union assembly has a loose mode to direct the exhaust port to a chosen direction anywhere in a 360° orientation, and a locked mode to lock the exhaust port in the chosen direction.

15. The noise suppressor of claim 14, wherein the cylindrical housing further comprises a noise suppressing assembly.

16. The noise suppressor of claim 15, wherein the noise suppressing assembly further comprises a replaceable module, and the solid top is removable.

17. The noise suppressor of claim 15, wherein the noise suppressing assembly further comprises a plurality of discs with holes.

18. The noise suppressor of claim 16, wherein the replaceable module further comprises a mesh material.

19. A natural gas pipeline venting port noise suppressor comprising:

a housing having a vent port at a side, and having a solid top;

said housing having a bottom with a threaded union assembly to connect to a pipeline venting port;

said pipeline venting port having a vent valve; and wherein the threaded union assembly has a loose mode to direct the vent port to a chosen direction and a locked mode to lock the vent port in the chosen direction.

20. The noise suppressor of claim 19, wherein the housing further comprises a cylinder with a removable solid top and a replaceable noise suppressor inside the cylinder.

21. The noise suppressor of claim 14, wherein the threaded union assembly further comprises an upper flange member sized to connect to a lower flange member on the pipeline venting port.

* * * * *